US012516531B2

(12) United States Patent
Schneider

(10) Patent No.: US 12,516,531 B2
(45) Date of Patent: Jan. 6, 2026

(54) FRAME FORMWORK ELEMENT

(71) Applicant: PERI SE, Weissenhorn (DE)

(72) Inventor: Werner Schneider, Erbach (DE)

(73) Assignee: PERI SE, Weissenhorn (DE)

( * ) Notice: Subject to any disclaimer, the term of this patent is extended or adjusted under 35 U.S.C. 154(b) by 533 days.

(21) Appl. No.: 17/794,237

(22) PCT Filed: Dec. 30, 2020

(86) PCT No.: PCT/EP2020/088025
§ 371 (c)(1),
(2) Date: Jul. 20, 2022

(87) PCT Pub. No.: WO2021/148232
PCT Pub. Date: Jul. 29, 2021

(65) Prior Publication Data

US 2023/0134027 A1 May 4, 2023

(30) Foreign Application Priority Data

Jan. 20, 2020 (DE) ..... 10 2020 101 188.1

(51) Int. Cl.
*E04G 17/00* (2006.01)
*E04G 17/065* (2006.01)

(52) U.S. Cl.
CPC ..... *E04G 17/007* (2013.01); *E04G 17/0652* (2013.01)

(58) Field of Classification Search
CPC ... E04G 17/007; E04G 17/0652; E04G 17/06; E04G 17/14
See application file for complete search history.

(56) References Cited

U.S. PATENT DOCUMENTS 842,722 A * 1/1907 Swinnerton ..... E04G 17/0714 249/43
1,937,109 A * 11/1933 Colt ..... E04G 17/0658 249/190
2,061,751 A * 11/1936 Bosco ..... E04G 17/0658 411/389

(Continued)

FOREIGN PATENT DOCUMENTS

DE 3405976 A1 8/1985
DE 102018203764 A1 9/2019

(Continued)

*Primary Examiner* — Gisele D Ford
(74) *Attorney, Agent, or Firm* — SLEMAN & LUND LLP

(57) ABSTRACT

A frame formwork element with a frame and a formwork shell which can be attached to the frame. The frame has at least two frame longitudinal parts and at least two frame transverse parts. At least one transverse bracing is fixed between the frame longitudinal parts, said transverse bracing having two transverse braces which run parallel to each other in a mutually spaced manner and between which a through-gap is formed for passing through anchor rods. At least one guide device for forming an anchor point can be inserted into the through-gap. The guide device has an anchor hole for passing through one of the anchor rods and a securing region for securing the guide device to the transverse bracing. In order to pass through the anchor rod, the guide device has a conical guide part (13) which is flush with the anchor hole.

11 Claims, 5 Drawing Sheets

(56) References Cited

U.S. PATENT DOCUMENTS 2,270,448 A * 1/1942 Juhl ..... E04G 17/0652 249/213
2,383,864 A * 8/1945 Judkins ..... E04G 17/0658 249/217
4,247,073 A * 1/1981 Vario ..... E04G 17/0721 249/46
4,899,978 A * 2/1990 Gates ..... E04G 17/0754 249/46
5,761,874 A * 6/1998 Hayakawa ..... E04G 17/0658 249/43
5,813,185 A * 9/1998 Jackson ..... E04G 17/0657 52/405.1
5,956,922 A * 9/1999 Liuska ..... E04G 17/045 249/43
6,024,339 A * 2/2000 Gates ..... E04G 17/06 249/193
8,272,620 B2 * 9/2012 Schwoerer ..... E04G 17/0752 249/40
8,464,997 B2 * 6/2013 Peneder ..... E04G 17/0752 249/213
9,222,271 B2 * 12/2015 Amon ..... E04G 17/0652
9,708,820 B2 * 7/2017 Berger ..... E04G 17/0652
9,822,534 B2 11/2017 Dingler
10,480,202 B1 11/2019 Colino Vega
10,662,660 B2 * 5/2020 Colino Vega ..... F16B 21/02
10,808,413 B2 * 10/2020 Colino Vega ..... E04G 17/0652
11,047,144 B2 * 6/2021 Colino Vega ..... E04G 17/0657
2003/0071189 A1 * 4/2003 Petkau ..... E04G 17/0657 249/190
2004/0079860 A1 * 4/2004 Ward ..... E04G 17/0651 249/190
2008/0307736 A1 * 12/2008 Trimmer ..... E04G 17/047 52/426
2012/0304570 A1 * 12/2012 Braun ..... E04G 17/0652 52/705
2014/0374568 A1 * 12/2014 Amon ..... E04G 17/0652 249/1
2015/0152909 A1 * 6/2015 Berger ..... E04G 17/0652 29/525.02
2015/0167329 A1 * 6/2015 Hagemes ..... E04G 17/0652 249/213
2018/0363308 A1 * 12/2018 Schmelzer ..... F16B 33/002
2019/0112825 A1 * 4/2019 Colino Vega ..... F16B 21/02
2019/0112826 A1 * 4/2019 Colino Vega ..... E04G 17/0657
2020/0032531 A1 * 1/2020 Colino Vega ..... E04G 17/0655
2020/0032532 A1 * 1/2020 Colino Vega ..... E04G 17/0652
2020/0032533 A1 * 1/2020 Colino Vega ..... E04G 17/065
2022/0259872 A1 * 8/2022 Schille ..... E04G 17/0657

FOREIGN PATENT DOCUMENTS

DE 102018205384 A1 10/2019
EP 0047550 B1 12/1983
EP 3156561 A1 4/2017
KR 20100122022 A 11/2010
WO 2008089442 A2 7/2008
WO 2014048908 A1 4/2014

* cited by examiner

FRAME FORMWORK ELEMENT

FIELD

The invention relates to a frame formwork element with a frame and a formwork shell which can be attached to the frame, wherein the frame has at least two frame longitudinal parts and at least two frame transverse parts, and wherein at least one transverse bracing is fixed between the frame longitudinal parts, said transverse bracing having two transverse braces which run parallel to each other in a mutually spaced manner and between which a through-gap is formed for passing through anchor rods.

The invention also relates to a guide device for a frame formwork element.

Furthermore, the invention relates to a formwork system having at least two frame formwork elements.

BACKGROUND

Frame formwork elements are used as parts of formwork systems, in particular for the production of concrete components. The frame formwork elements are arranged in this case in such a way that they form a mold into which a hardenable building material, i.e. an initially liquid and then hardening building material, mostly concrete, is introduced for the production of a component, for example a wall element. After hardening of the building material, the frame formwork elements are generally removed.

The frame formwork elements have a frame to which the formwork shell can be attached or is attached.

On the one hand, the frame of the frame formwork elements should be stable in order to be able to transfer the loads occurring when filling the formwork system with hardenable concrete. On the other hand, the frames should be sufficiently rigid to ensure high dimensional accuracy and to avoid unwanted deformation.

The structure of a surface of the concrete component facing the formwork shell is determined by the formwork shell attached to the frame. A front side of the formwork shell faces the concrete to be filled, i.e. the front side of the formwork shell forms the concrete-contacting surface, while the rear side of the formwork shell is attached to the frame.

It is known from the general prior art that two frame formwork elements are positioned opposite to each other at a distance, so that concrete can be poured between the frame formwork elements located opposite one another. The frame formwork elements are connected and braced together by rods, commonly designated as anchor rods. In this case, the anchor rods pass through anchor bores in the formwork shell of the frame formwork elements and are generally fixed with anchor fixations in the form of nuts on a rear side of the frame formwork elements. For this purpose, the nuts are applied to the ends of the anchor rods. A one-sided or two-sided anchoring technology can be used to brace the frame formwork elements. Furthermore, the use of spacer tubes or cladding tubes can also be provided.

A generic frame formwork element is known from EP 0 047 550 B1. A rectangular frame formwork element is disclosed in this case, which has two frame longitudinal parts and two frame transverse parts. In this case, when the frame formwork element is correctly positioned for use, the frame longitudinal parts extend in the vertical direction, while the frame transverse parts run in the horizontal direction, i.e. transversely, on the upper and lower side of the frame formwork element.

The frame longitudinal parts have through-bores through which anchor rods are passed through for bracing the frame formwork elements.

It is also known from EP 0 047 550 B1 to fix transverse bracings between the frame longitudinal parts. In this case, the transverse bracings run parallel to the frame transverse parts. The transverse bracings have two transverse braces which run parallel to each other in a mutually spaced manner and between which a through-gap is formed for passing through anchor rods.

This configuration makes it possible to pass anchor rods both through the through-openings in the frame longitudinal parts and through the through-gaps between the transverse braces. Thus, anchor rods can also be inserted between two frame longitudinal parts in order to fix or brace the frame formwork elements in a mutually spaced manner.

A disadvantage of the solution known from EP 0 047 550 B1, however, is that the guidance of the anchor rods, which extend through the through-gap, is insufficient. Furthermore, the sealing to the formwork shell is also insufficient, so that concrete poured between the frame formwork elements can leak out along the anchor rods.

It is known from WO 2014/048908 A1 to use a one-piece transverse bracing between the frame longitudinal parts, which has a plurality of bores for passing through anchor rods. Although the solution known from WO 2014/048908 A1 improves the guidance of the anchor rods due to the defined design of the bores in the transverse bracing, it has the disadvantage that the anchor rods have to be fixed at the predefined points or in the specified grid, so that different pressure requirements and concrete patterns cannot be accommodated. Furthermore, the production costs of a transverse bracing of this type are comparatively high.

SUMMARY

The present invention is therefore based on the object of improving the frame formwork elements known from the prior art for forming a hardenable building material, in particular to allow the anchor rods to be positioned as required and to allow a defined guidance of the anchor rods.

The present invention is also based on the object of providing a guide device for a frame formwork element which allows positioning of the anchor rods as required and allows a defined guidance of the anchor rods.

The present invention is also based on the object of improving the formwork systems known from the prior art, in particular to allow the anchor rods to be positioned as required and to allow a defined guidance of the anchor rods.

With regard to the frame formwork element, the object is achieved by a frame formwork element with a frame and a formwork shell which can be attached to the frame, wherein the frame has at least two frame longitudinal parts and at least two frame transverse parts, and wherein at least one transverse bracing is fixed between the frame longitudinal parts, said transverse bracing having two transverse braces which run parallel to each other in a mutually spaced manner and between which a through-gap is formed for passing through anchor rods, wherein at least one guide device for forming an anchor point can be inserted into the through-gap, wherein the guide device has an anchor hole for passing through one of the anchor rods and a securing region for securing the guide device to the transverse bracing, wherein the guide device for passing through the anchor rod has a conical guide part which is flush with the anchor hole.

With regard to the guide device, the object is achieved by a guide device for a frame formwork element, wherein the guide device has an anchor hole for passing through an anchor rod and a securing region for securing the guide device to a transverse bracing of the frame formwork element.

With regard to the formwork system, the object is achieved by a formwork system having at least two frame formwork elements and a plurality of anchor rods in order to brace the frame formwork elements in a mutually spaced manner.

The frame formwork element according to the invention has a frame and a formwork shell that can be attached to the frame. The frame has at least two frame longitudinal parts and at least two frame transverse parts. At least one transverse bracing is fixed between the frame longitudinal parts and has two transverse braces which run parallel to each other in a mutually spaced manner and between which a through-gap is formed for passing through anchor rods. According to the invention, it is provided that at least one guide device for forming an anchor point can be replaced in the through-gap, wherein the guide device has an anchor hole for passing through one of the anchor rods and a securing region for securing the guide device to the transverse bracing. Furthermore, it is provided according to the invention that the guide device for passing through the anchor rod has a conical guide part which is flush with the anchor hole.

The frame formwork elements according to the invention are used as parts of formwork systems for forming a hardenable building material.

The building material used for forming is a hardenable building material, which means that the building material is liquid during filling and hardens after filling. Concrete is usually used as the building material.

Insofar as the specific term "concrete" is used below in the scope of the description of the invention instead of the general term "building material," this is also to be understood as a disclosure for the general term "building material."

A plurality of advantages result from the fact that at least one guide device for forming an anchor point can be inserted or is inserted into the through-gap. On the one hand, the guide device can be positioned along the through-gap at a suitable position and thus as required, in particular taking into account the pressure requirement and the concrete patterns. On the other hand, the anchor hole of the guide device, which is provided for passing through one of the anchor rods, can be designed in a simple manner in such a way that the anchor rod to be passed through is guided in a defined manner and thus the escape of concrete along the anchor rod can also be avoided.

The securing region of the guide device, which is provided for fixing the guide device to the transverse bracing, can be designed in a simple manner in such a way that the guide device is reliably fixed to the transverse bracing, for example to one, preferably both transverse braces.

The fixation of the guide device to the transverse bracing can take place in a form-fitting and/or force-fitting and/or material-fitting manner. It can be particularly suitable to secure the guide device to the transverse bracing by clamping, gluing, clipping, screwing, riveting, or soldering. The securing preferably takes place in such a way that the connection is then detachable again. The guide device is preferably held in a clamped manner on the transverse bracing or a transverse brace, particularly preferably on both transverse braces.

The anchor point formed by the guide device can thus be installed or removed as required.

The solution according to the invention makes it possible to arrange the anchor points flexibly and to remove them again.

In the event of contamination or a defect, the guide device can be easily replaced or cleaned.

The solution according to the invention also makes it possible to provide a common frame formwork element or a common frame for different formwork systems or uses. Guide devices can then be fixed in the through-gap or through-gaps as required in order to form anchor points at the corresponding desired positions.

The frame formwork element can easily be provided with a suitable formwork shell, or the formwork shell can be provided with suitable anchor bores through which the anchor rods can be passed through.

The guide device can be designed in such a way that the anchor hole is adapted to the anchor rod provided for passing through.

Due to the fact that the guide device is secured to the transverse bracing and the transverse bracing is fixed to the frame or between frame longitudinal parts, the main load is carried by the frame, which is preferably made of metal, in particular steel or aluminum. The object of the guide device can be reduced in this case to guiding and holding the anchor rod that is passed through.

In particular, the frame transverse parts are the frame transverse part which runs at the upper end of the frame and the frame transverse part which runs at the lower end of the frame. However, it is possible for further frame transverse parts to also run between the upper frame transverse part and the lower frame transverse part, in particular to increase the stability of the frame of the frame formwork element and to serve as contact surfaces for the formwork shell.

The frame longitudinal parts are, in particular, a left and a right frame longitudinal part, i.e. two frame longitudinal parts which delimit the frame on the outside. However, further frame longitudinal parts can optionally also be formed between the two frame longitudinal parts. The frame formwork element preferably has only the two outer, i.e. the left and the right, frame longitudinal parts, between which the transverse bracings provided according to the invention for forming the through-gaps are then arranged. If a plurality of frame longitudinal parts are provided, the transverse bracings can preferably each be formed between two adjacent frame longitudinal parts.

The solution according to the invention allows the formation of an inexpensive and easily exchangeable anchor point. Furthermore, the solution according to the invention increases the flexibility of the frame formwork element, in particular since different pressure requirements and concrete patterns can be accommodated.

According to the invention, it is preferably provided that the guide device can be inserted or is inserted within the frame.

It is advantageous if the through-gap, which is formed between two transverse braces which run in a mutually spaced manner, extends between the two frame longitudinal parts on which the transverse braces are fixed. If necessary, the through-gap can also be divided into a plurality of partial regions, in particular in such a way that supports are arranged between the transverse braces which preferably run orthogonally to the transverse braces and connect them to each other. However, it is preferable in particular to allow the guide device to be fixed as flexibly as possible, if the through-gap is delimited only by the two transverse braces and the two frame longitudinal parts.

It is advantageous if the transverse bracing runs parallel to the frame transverse parts and thus orthogonally to the frame longitudinal parts.

It is also advantageous if the frame formwork element has a plurality of transverse bracings which each form two transverse braces which run parallel to each other in a mutually spaced manner and between which a through-gap is formed.

It is advantageous if the guide device has a length that corresponds at least to the depth of the frame of the frame formwork element. The length of the guide is understood to be the extent of the guide means parallel to the longitudinal axis of the anchor rod to be passed through, i.e. the length of the guide means extends, when the guide device is correctly installed, orthogonally to the plane of the frame of the frame formwork element. The length of the guide device is preferably selected in such a way that it corresponds to the depth or the thickness of the frame formwork element, including the thickness of the formwork shell which can be attached or is attached to the frame. The guide device can thus extend into a corresponding anchor bore in the formwork shell.

The guide device is preferably formed and arranged in such a way that a front end of the guide device, which is the end that faces the formwork shell, terminates flush with the formwork shell on the concrete side. This means that the front end of the guide device lies in a plane with the front side of the formwork shell facing the concrete to be filled.

The guide device is preferably also designed in such a way that it terminates flush with the rear side of the frame, i.e. the side of the frame facing away from the formwork shell.

Due to the fact that the guide device according to the invention has a conical guide part, the associated anchor rod can be introduced into the guide device and guided in a defined manner in a particularly advantageous manner. Furthermore, a design of the guide device can thus be implemented in a particularly simple manner in such a way that it has a length that preferably extends at least over the depth of the frame.

The conical guide part can be formed conically over the entire length or it can be provided that only a section of the guide part, in particular a section that makes up more than 50% of the length of the guide part, in particular more than 70% of the length, is formed conically. The conical guide part can in particular be designed in such a way that a start and/or an end region of the otherwise conical guide part is not formed conically, in particular has a constant diameter.

According to the invention, it can be provided that the guide device forms exactly one anchor point and the guide device has exactly one anchor hole for this purpose.

A configuration of this type has proven to be particularly suitable.

According to the invention, it can also be provided that the guide device has a seal receptacle into which a seal can be detachably inserted or on which a seal is captively fixed, wherein the seal receptacle is positioned in such a way that the seal seals the guide device, in particular the conical guide part, relative to an anchor bore in the formwork shell.

Due to the fact that the guide device has a seal receptacle, it is easy to implement a seal between the guide device, in particular the conical guide part of the guide device, and the anchor bore in the formwork shell. The seal receptacle can be provided in this case with a seal that is independent of the guide device. However, it is also possible for the guide device to be designed in such a way that the seal is an integral part of the guide device.

It can preferably be provided for the seal to be sprayed onto the seal receptacle.

The seal preferably runs around the guide device or the conical guide part in an annular manner.

The seal can preferably have a sealing lip and/or a sealing bead.

The seal can in particular also be a separate component which is connected to the guide device. The seal receptacle of the guide device can be designed in this case in such a way that it makes it possible to place the seal on the outside of the conical guide part or to integrate it into the conical guide part. If the seal is inserted into the conical guide part, it can preferably be provided that the seal, as part of the guide device, protrudes beyond the front end of the guide device and runs radially outwards on the front side in order to fill a gap between the guide device, in particular the front end of the conical guide part, and the anchor bore in the formwork shell.

The seal receptacle can be designed in such a way that the seal can be inserted or permanently installed. Silicone, in particular, can also be suitable as a material for the seal.

The front end of the conical guide part preferably has a constant diameter, i.e. is not formed conically. The guide device is preferably secured to the transverse bracing in such a way that the front—not conically formed—end of the conical guide part penetrates into the anchor bore of the formwork shell or is positioned in the anchor bore. In this case, the front end of the conical guide part can preferably form the seal receptacle.

According to the invention, it can also be provided that the anchor hole, the conical guide part, the seal receptacle, and the securing region of the guide device are formed in one piece and/or are formed from the same material.

A one-piece design or a design made from the same material has proven to be particularly suitable with regard to the manufacture of the guide device.

It can be provided, for example, that the guide device is formed of cast steel.

It is advantageous if the anchor hole, the conical guide part, the seal receptacle, and the securing region of the guide device are formed of plastics material.

A design of the guide device made of plastics material has proven to be particularly suitable, in particular with regard to the production of the guide device and in order to achieve the object provided.

According to the invention, a sealing closure can also be provided in order to close the anchor bore in the formwork shell flush on the side facing the concrete.

It has turned out to be advantageous if sealing closures are provided for the anchor bores in the formwork shell in order to close the anchor bore in the formwork shell after removal or when an anchor point is not used or when the guide device and thus the anchor point have been removed. The sealing closure can preferably be formed as a sealing plug. Alternatively, it can also be provided that the formwork shell is changed.

The solution according to the invention makes it possible to provide different anchor bores in a formwork shell, which are each closed by a sealing closure when not in use, so that only the anchor bores in the formwork shell, which are required for passing through the anchor rods, are open.

According to the invention, it can also be provided that the frame longitudinal parts have a plurality of through-bores for passing through anchor rods.

It has turned out to be particularly suitable if the frame longitudinal parts have, in a manner known in principle, a plurality of through-bores for passing through anchor rods.

In combination with the solution according to the invention, in which additional anchor points are formed by the guide device in the through-gaps, the frame formwork elements can thus be braced relative to each other in a particularly suitable manner by means of the anchor rods. The through-bores in the frame longitudinal parts can preferably be arranged in a grid in this case. A distance between two through-bores can be, for example, 300 mm to 700 mm, preferably 400 mm to 600 mm, further preferably 500 mm to 600 mm, in particular 540 mm. As a result, a distance that is favorable in terms of deformation is selected for the through-bores. In principle, through-bores can also be provided in the frame transverse parts in addition or as an alternative.

It is advantageous if the at least one through-gap is arranged flush between a pair of through-bores which are positioned at the same height on different frame longitudinal parts.

An arrangement of this type has proven to be particularly suitable for absorbing the compressive forces. In principle, however, it is possible to form the through-gap, into which a guide device for forming an anchor point is inserted, at any desired height between two frame longitudinal parts. A plurality of through-bores are preferably located in each of the two frame longitudinal parts. A through-gap then runs flush between two through-bores that are made at the same height but in different frame longitudinal parts in such a way that the transverse bracing that forms the through-gap has a transverse brace that runs above the two passage bores and a transverse brace that runs below the two through-bores.

According to the invention, it can also be provided that at least two, preferably at least three, transverse bracings are formed in the frame formwork element, in the through-gap of which in each case at least one guide device is inserted.

It has been shown that it is advantageous if the frame formwork element has at least two, preferably at least three, transverse bracings. It can be particularly suitable in this case if exactly two or three or four transverse bracings are provided. As a result, the pressure requirements can be met in a particularly advantageous manner.

The transverse bracings are preferably arranged vertically offset from each other with the same grid spacing.

According to the invention, it can be provided that the guide device can be used at any desired position along the through-gap and can be secured to the transverse bracing.

According to the invention, it can also be provided that two, three, or more guide devices are inserted into the through-gap of the at least one transverse bracing.

It can be sufficient if a guide device is inserted into a through-gap. If only one guide device is inserted into the through-gap in order to form an anchor point there, it can be advantageous if the guide device is arranged centrally between the two frame longitudinal parts between which the through-gap is formed. If two, three, or more guide devices are inserted into the through-gap, it can be advantageous if they have a uniform grid spacing, but this is not absolutely necessary. The positioning of the guide devices can take place depending on the requirements.

If a plurality of through-gaps are provided, it can be provided that at least one guide device is inserted into each of the through-gaps. In principle, it is also possible for two or more guide devices to be inserted into one or more of the through-gaps. In principle, it is possible to determine separately for each through-gap how many guide devices are inserted and at what position they are positioned. However, it can be advantageous if the guide devices are positioned in all through-gaps in such a way that the guide devices lie vertically one above the other.

According to the invention, it can be provided that at least two guide devices are arranged in different through-gaps in such a way that the guide devices are arranged in a line that runs parallel to the frame longitudinal parts.

The anchor rods, which are inserted into the conical guide part or the anchor hole and passed through the anchor bore in the formwork shell, can be formed conically, i.e. the diameter of the anchor rod tapers starting from one end to the other end. Alternatively or additionally, it can also be provided that the anchor rod is surrounded by a sleeve in the region in which it runs between the two frame formwork elements, so that the anchor rod can still be pulled out even after pouring in and hardening the concrete.

Generally, the two ends of an anchor rod have a thread onto which nuts can be screwed as anchor fixations. The central region of an anchor rod, which is adjacent to concrete during concreting, preferably either has a smooth surface or is encased in a sleeve or cladding tube with a smooth surface. The effective length of the anchor rod and thus the strength (thickness) of the concrete component to be concreted, for example a wall, is determined by the anchor fixations.

The invention also relates to a guide device for a frame formwork element, wherein the guide device has an anchor hole for passing through an anchor rod and a securing region for securing the guide device to a transverse bracing of the frame formwork element.

According to the invention, the guide device can have a length that corresponds at least to the depth of a frame of the frame formwork element.

According to the invention, it can also be provided that the guide device for passing through the anchor rod has a conical guide part which is flush with the anchor hole.

Furthermore, it can be provided according to the invention that the guide device has a seal receptacle into which a seal can be detachably inserted or on which a seal is captively fixed, wherein the seal receptacle is positioned in such a way that the seal seals the guide device, in particular the conical guide part, relative to an anchor bore in a formwork shell which can be attached to the frame formwork element.

According to the invention, it can also be provided that the anchor hole, the conical guide part, the seal receptacle, and the securing region of the guide device are formed of plastics material.

The invention also relates to a formwork system, which comprises at least two frame formwork elements and a plurality of anchor rods in order to brace the frame formwork elements in a mutually spaced manner.

According to the invention, the formwork system can have a set of guide devices, wherein the set has different guide devices for different types of anchor rods.

By forming a set with different guide devices for different types of anchor rods, it is possible to convert a formwork system or a frame formwork element by installing, preferably clamping, a suitable guide device on a transverse bracing of the frame formwork element in such a way that the frame formwork element can be used in connection with the anchor rod provided. The set with the different guide devices makes it possible to adjust an existing formwork system or frame formwork element to different pressure requirements and concrete patterns.

For this purpose, all that is required is to secure the corresponding guide device(s) to the provided transverse bracings.

Features that have been described in connection with the frame formwork element according to the invention can of course also be advantageously implemented for the guide device according to the invention or the formwork system according to the invention—and vice versa. Furthermore, advantages that have already been mentioned in connection with the frame formwork element according to the invention can also be understood in relation to the guide device or the formwork system according to the invention—and vice versa.

In addition, it should be pointed out that terms such as "comprising," "having," or "with" do not exclude any other features or steps. Furthermore, terms such as "one" or "the" which refer to a single number of steps or features do not exclude a plurality of features or steps—and vice versa.

An exemplary embodiment of the invention is described in more detail below with reference to the drawing.

The figures show a preferred exemplary embodiment in which individual features of the present invention are shown in combination with each other. The features of the exemplary embodiment can also be implemented independently of the other features of the exemplary embodiment.

In the figures, functionally identical elements are provided with the same reference signs.

BRIEF DESCRIPTION OF THE DRAWINGS

The figures show the following:

FIG. 8 a plan view of a rear side of a frame formwork element of a formwork system according to the invention, in which case an anchor rod is inserted into each of the guide devices and an anchor fixation is screwed on.

DETAILED DESCRIPTION

Formwork systems and frame formwork elements and methods for forming a hardenable building material are well known from the general prior art, for which reference is made to DE 10 2018 203 764 A1, for example. Therefore, only the features relevant to the invention will be discussed in more detail below.

FIGS. 1, 2, 8, and 9 show a frame formwork element 1 for forming a hardenable building material. In the exemplary embodiment, the building material is preferably concrete. However, the invention is not limited to this. The exemplary embodiment is to be understood in such a way that, instead of concrete, another hardenable building material can also be used for forming.

The frame formwork element 1 shown in FIGS. 1, 2, 8, and 9 has a frame 2 and a formwork shell 3 which is attached or can be attached to the frame 2.

Figure 1:
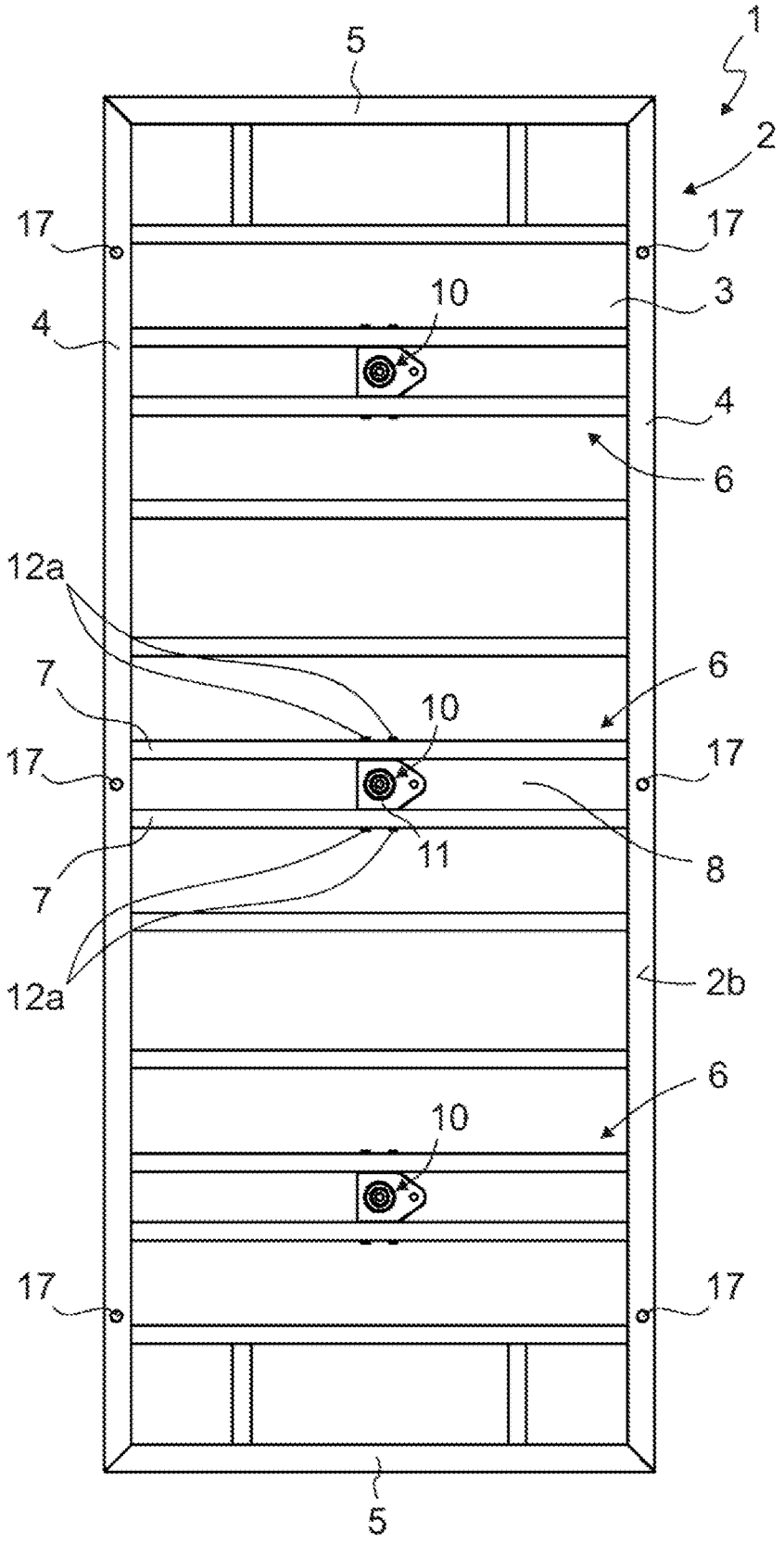
FIG. 1 a plan view of a rear side of a frame formwork element according to the invention.
Figure 8:
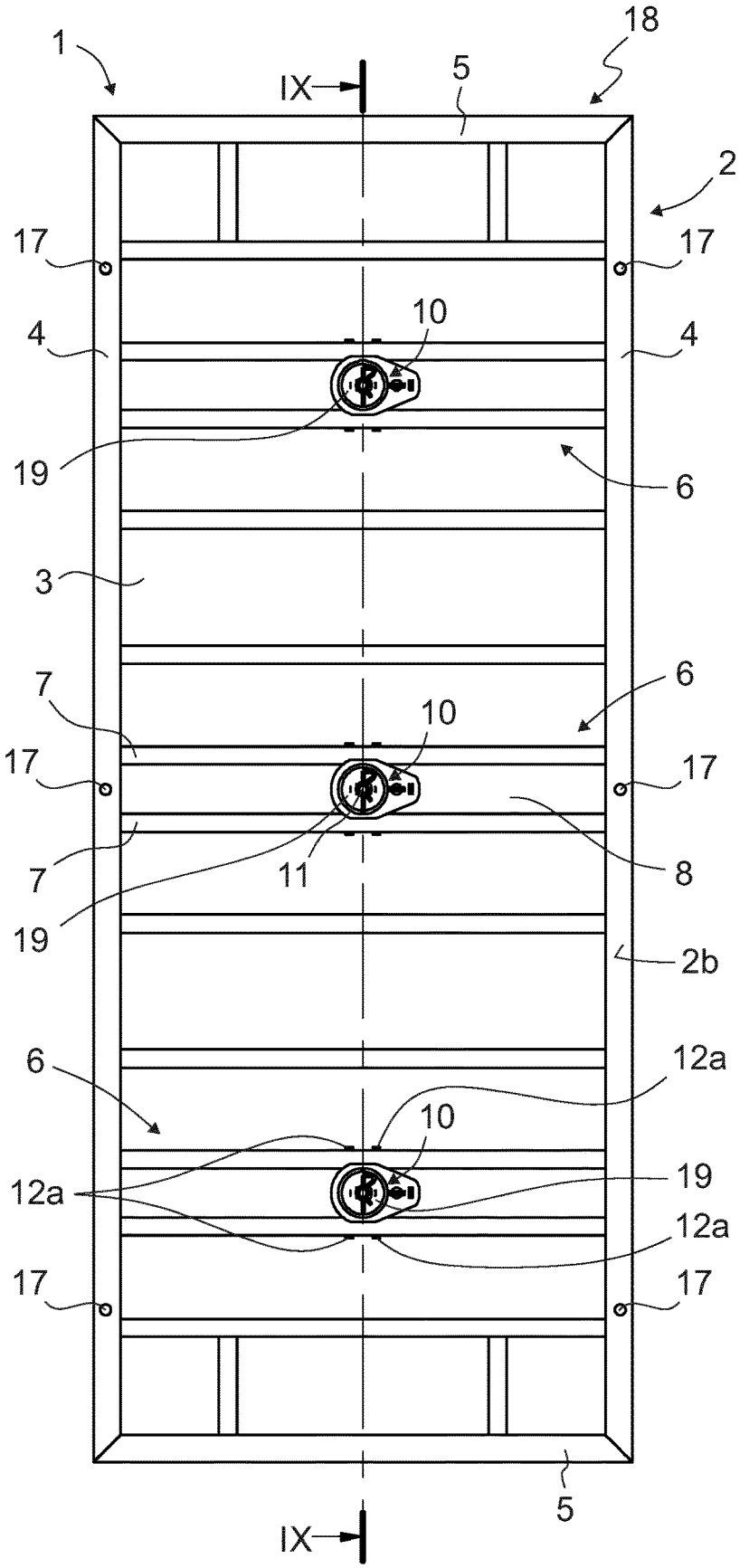
Figure 9:
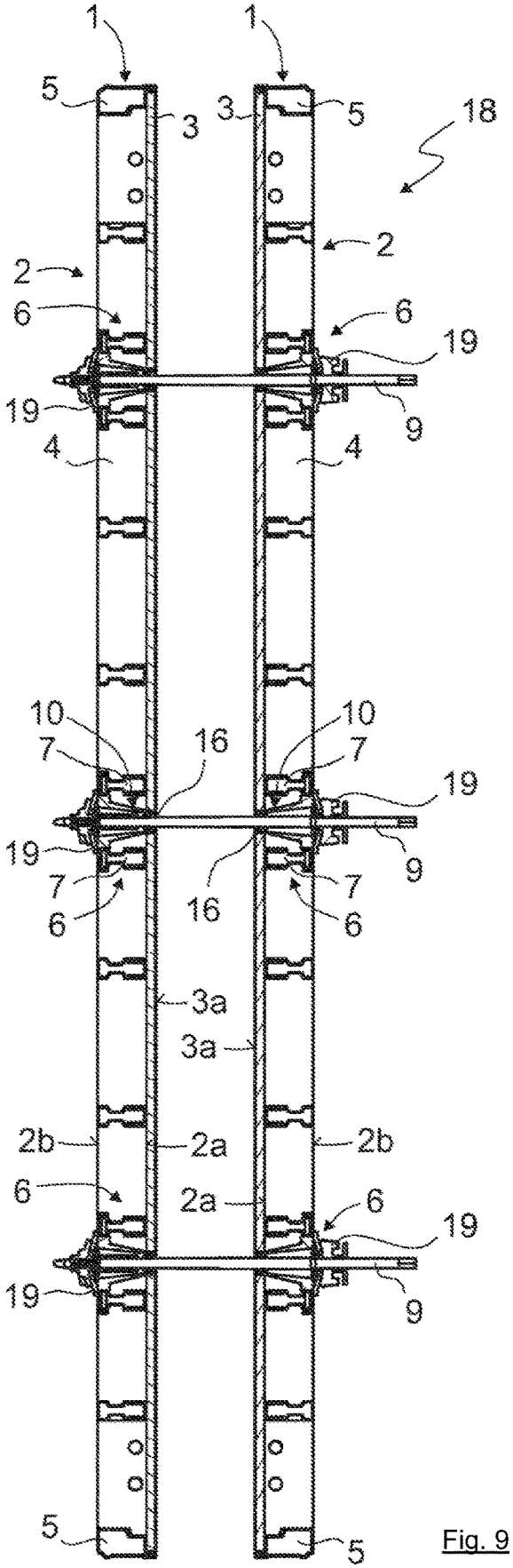
FIG. 9 a longitudinal section through the formwork system according to the invention along the line IX-IX of FIG. 8.

The frame 2 has at least two frame longitudinal parts 4 and at least two frame transverse parts 5. The outer contours of the frame 2 are each formed in this case by two frame longitudinal parts 4, namely a left and a right frame longitudinal part 4, and two frame transverse parts 5, namely an upper and a lower frame transverse part 5. As shown in FIGS. 1, 8, and 9, further frame transverse parts are arranged between the upper and the lower frame transverse part 5, but these are not designated in more detail. In principle, however, the additional frame transverse parts can also be omitted. Furthermore, it is possible for the frame 2 to have further frame longitudinal parts which run between the two outer frame longitudinal parts 4, namely the left and the right frame longitudinal part 4. In the exemplary embodiment, however, only two frame longitudinal parts 4 are shown or provided. In FIGS. 1 and 8, additional bracing parts, not designated in more detail, are shown, which extend parallel to the frame longitudinal parts 4 and connect the upper frame transverse part 5 or the lower frame transverse part 5 to an adjoining further frame transverse part, not designated in more detail. A configuration of this type can be useful for stiffening.

The invention and the exemplary embodiment are not to be understood as being limited to a specific configuration of the frame 2 with a specific arrangement or number of frame longitudinal parts 4 and frame transverse parts 5.

As can be seen from FIGS. 1,2, 8, and 9, it is provided in the exemplary embodiment that at least one transverse bracing 6 is fixed between the frame longitudinal parts 4, said transverse bracing having two transverse braces 7 which run parallel to each other in a mutually spaced manner and between which a through-gap 8 is formed for passing through anchor rods 9.

In the exemplary embodiment, three transverse bracings 6 of this type are provided as an example. In principle, however, the exemplary embodiment is to be understood in such a way that only one or at least two, preferably three or more, transverse bracings 6 are provided in a frame formwork element 1.

In the exemplary embodiment, it is provided that at least one guide device 10 for forming an anchor point is inserted into the through-gap 8 which is formed by a transverse bracing 6. In the exemplary embodiment, it is provided that a guide device 10 is inserted into each through-gap 8. In principle, however, it can also be provided that no guide device 10 is inserted into a through-gap 8. Furthermore, it can also be provided that two, three, or more guide devices 10 are inserted into a through-gap 8. The configuration of the through-gaps 8 with one, two, or more guide devices 10 or not using a guide device 10, i.e. not forming an anchor point in the through-gap 8, can be made dependent on the requirements placed on the frame formwork element 1, in particular the pressure requirements and the concrete pattern.

A particularly suitable guide device 10 is shown in more detail in FIGS. 3 to 7. A guide device 10 of this type is also used in FIGS. 1, 2, 8, and 9. However, the invention and the exemplary embodiment are not limited to the specific configuration of the guide device 10, as shown in FIGS. 3 to 7.

The guide device 10 is preferably detachably connected to the transverse bracing 6.

The connection of the guide device 10 to the transverse bracing 6 can take place in a form-fitting and/or material-fitting and/or force-fitting manner. It can preferably be provided for the guide device 10 to be screwed, riveted, clipped, or particularly preferably braced to the transverse bracing 6.

As shown in the exemplary embodiment, the guide device 10 has an anchor hole 11 for passing through one of the anchor rods 9 and a securing region 12 for securing the guide device 10 to the transverse bracing 6. In FIGS. 1 and 8, it is only shown by way of example that the securing region 12 can be designed in such a way that it has clamping parts 12*a* in order to brace the guide device 10 to the transverse bracing 6.

It is preferably provided for the guide device 10 to be secured, preferably braced, to both transverse braces 7 of the transverse bracing 6.

As can be seen in particular from FIGS. 3 to 7, it can be provided in the exemplary embodiment that the guide device 10 has a conical guide part 13 for passing through the anchor rod 9, said guide part being flush with the anchor hole 11.

The conical guide part 13 tapers in this case, starting from the securing region 12 in the direction of the front side of the guide device 10. In the region of the front side of the guide device 10, a seal receptacle 14 is provided in the exemplary embodiment. In principle, the seal receptacle 14 can have any desired design. In the exemplary embodiment, it can be provided that the seal receptacle 14 is designed in such a way that a seal 15 is detachably fitted or inserted thereon. In the exemplary embodiment, it is provided that the seal 15 is inserted into the seal receptacle 14. The seal 15 is designed in this case in such a way that it forms a sealing lip that is not designated in more detail.

Figure 7:
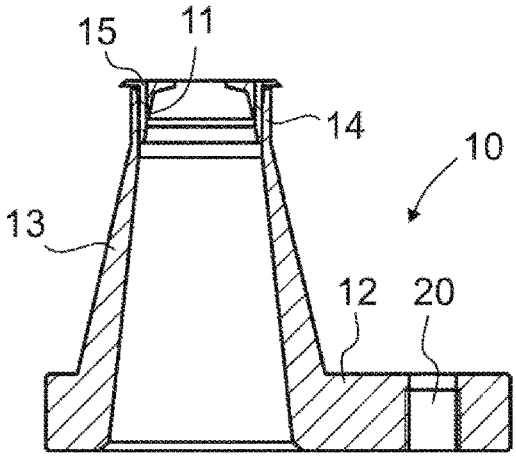
FIG. 7 a section through the guide device according to the invention along the line VII-VII of FIG. 6.

The seal 15 can be designed in such a way that it can be detachably connected to the seal receptacle 14, as is shown in FIGS. 3 to 7, in particular in FIG. 7. In FIG. 7, it is shown that the seal 15 is inserted, for example pressed, into the seal receptacle 14 which is the front end of the conical guide element 13. The seal 15 is preferably captively connected to the seal receptacle 14 of the guide device 10. The seal receptacle 14 and the seal 15 are positioned in such a way that the seal 15 seals the conical guide part 13 relative to an anchor bore 16 in the formwork shell 3 when the guide device 10 is correctly installed. The conical guide part 13 is in this case flush with the anchor bore 16.

In the exemplary embodiment, it is provided that the front end of the conical guide part 13 has a constant diameter, i.e. it is not formed conically. It is provided that the front end of the guide part 13 runs in the anchor bore 16 when the guide device 10 is correctly installed.

The seal 15 can be formed of any suitable material, in particular rubber, plastics material, or silicone. The seal 15 can also be connected to the seal receptacle 14 in such a way that it is sprayed on or vulcanized on. The seal 15 can also be formed as an integral part of the guide device 10.

In the exemplary embodiment, it is provided that the guide device 10 is formed in one piece, i.e. the anchor hole 11, the conical guide part 13, the seal receptacle 14, and the securing region 12 of the guide device 10 are made in one piece with each other. Furthermore, it is preferably provided in the exemplary embodiment that the guide device 10 or the aforementioned parts of the guide device 10 are formed of the same material. For this purpose, it can be provided that the guide device 10 is formed of cast steel. However, it is particularly advantageous if the guide device 10 is formed of plastics material.

In a way that is not shown in more detail, it can be provided in the exemplary embodiment that the anchor bores 16 made in the formwork shell 3 are closed flush with a sealing closure on the side facing the concrete if the anchor bores 16 are not used or if the guide device 10 is not installed or uninstalled. In this case, the sealing closure can preferably be formed as a sealing plug.

In the exemplary embodiment, in FIGS. 1 and 8, it is shown that the frame longitudinal parts 4 can have a plurality of through-bores 17 for passing through anchor rods 9.

Furthermore, it is shown in FIGS. 1 and 8 as an example that it can be advantageous if a through-gap 8 is arranged flush between a pair of through-bores 17 which are positioned on different frame longitudinal parts 4 at the same height. An arrangement of this type is shown as an example in the middle of the three through-gaps 8. An arrangement of this type can in principle also be optionally provided for the other through-gaps 8. Of course, the exemplary embodiment is not limited to a through-gap 8 being arranged flush between a pair of through-bores 17.

In principle, the guide devices 10 can be inserted at any desired position along a through-gap 8 and can be secured to the transverse bracing 6, preferably to both transverse braces 7, of a transverse bracing 6. In the exemplary embodiment, it is shown as an example that the guide devices 10 are positioned centrally in relation to the horizontal extent of the through-gap 8, but the exemplary embodiment is not to be understood as being limited to this. The positioning of the guide device 10 can depend in particular on the requirements, in particular the pressure requirements and the concrete pattern.

Figure 2:
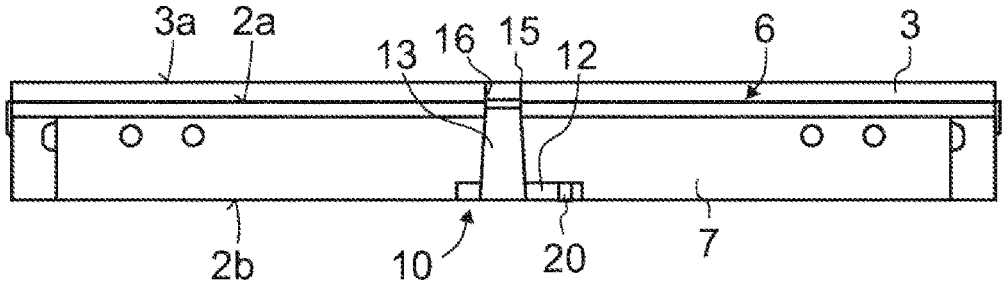
FIG. 2 a cross section through a frame formwork element according to the invention in a region in which a guide device for forming an anchor point is inserted into a through-gap.
Figure 3:
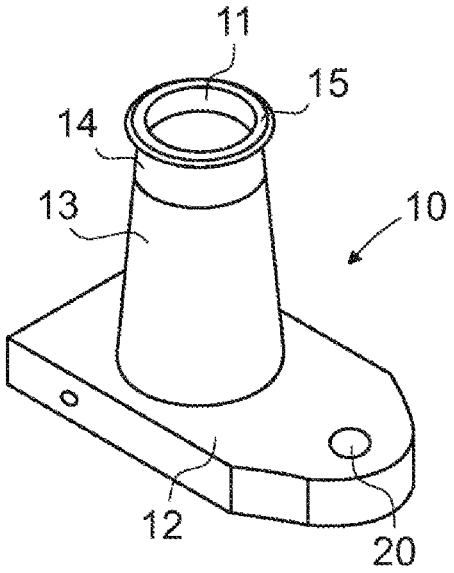
FIG. 3 a perspective view from the front of a guide device according to the invention for forming an anchor point.
Figure 4:
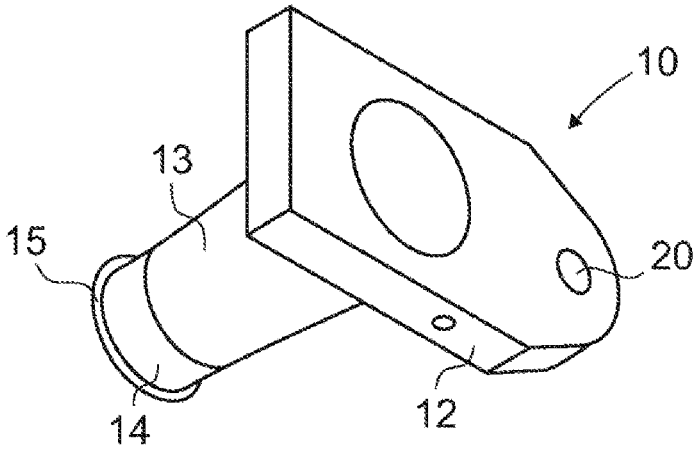
FIG. 4 a perspective view from behind of the guide device according to the invention according to FIG. 3.
Figure 5:
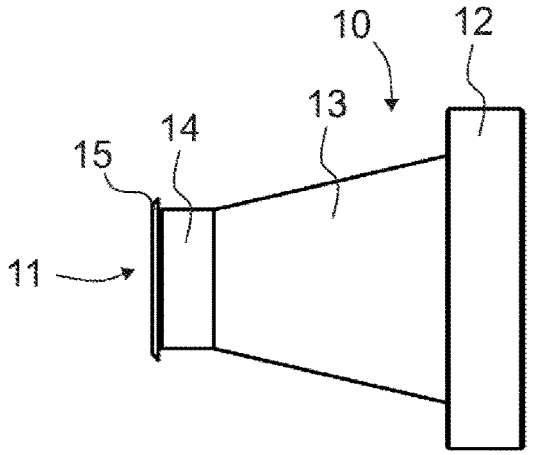
FIG. 5 a side view of the guide device according to the invention according to FIG. 3.
Figure 6:
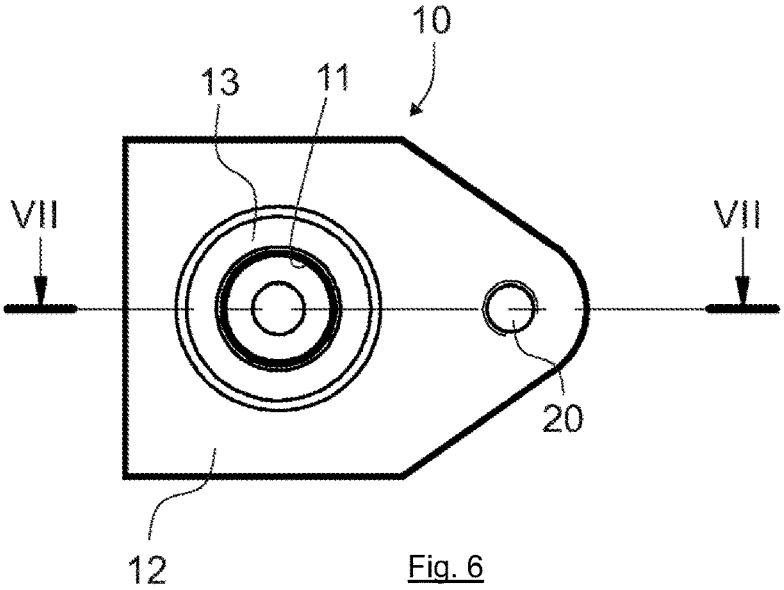
FIG. 6 a plan view of the rear side of the guide device according to the invention according to FIG. 3.

As shown in particular in FIGS. 2 and 9, the guide device 10 preferably has a length which corresponds at least to the depth of a frame 2 of the frame formwork element 1. In the exemplary embodiment, it is provided that the guide devices 10 have a length designed in such a way that a rear end of the guide device 10, on which the securing region 12 is formed, preferably runs in a plane with a rear side 2*b* of the frame 2, as is shown in principle in FIG. 2. The front side of the guide device 10 extends in this case so far in the direction of the front side 2*a* of the frame 2 that the front side of the guide device 10, i.e. the front end of the conical guide part 13, penetrates into an anchor bore 16 in the formwork shell 3. This is also shown as an example in FIG. 2 and also in FIG. 9. In this case, the guide device 10 has a length in such a way that the front end of the guide device 10 or, in the exemplary embodiment, the seal 15 placed there, terminates flush with the concrete-contacting side of the formwork shell 3, i.e. the front side 3*a* of the formwork shell 3. The seal receptacle 14 or at least part of the seal 15 is located in this case within the anchor bore 16 or is positioned in such a way that the seal 15 closes a gap between the front end of the conical guide part 13 penetrating the anchor bore 16 and the inner wall of the anchor bore 16 of the formwork shell 3. This reliably prevents concrete from escaping in this region through the seal 15.

A formwork system 18 with (at least) two frame formwork elements 1 is shown in principle in FIGS. 8 and 9.

FIG. 8 shows in this case a plan view of the rear side 2*b* of the frame 2 of a frame formwork element 1 of the formwork system 18. The frame formwork elements 1 are braced in a mutually spaced manner by the anchor rods 9 inserted into the guide devices 10 according to the invention.

The formwork system 18 according to FIGS. 8 and 9 has, as an example, six guide devices 10 according to the invention, so that three anchor points are formed in each of the two frame formwork elements 1. This is shown in FIG. 9. The frame formwork elements 1 are positioned in this case in a known manner in such a way that two anchor points, in this case two guide devices 10, are flush with each other.

Furthermore, the formwork shells 3 of the corresponding frame formwork elements 1 have the anchor bores 16 already described, through which the associated anchor rods 9 can be inserted.

In a way that is not shown in more detail, it can also be provided that further anchor rods 9 are also guided through the through-bores 17 in the frame formwork elements 1.

According to this principle, a plurality of frame formwork elements 1 can be connected to each other in a manner known in principle in such a way that they together form a formwork for forming a hardenable building material, in particular concrete.

In fact, it is shown in FIGS. 8 and 9 that both frame formwork elements 1 have the guide devices 10 according to the invention. In principle, however, it is also possible for only one of the frame formwork elements 1 to have the guide devices 10 according to the invention and for the anchor point to be provided in the associated second frame formwork element 1 in a conventional manner, for example through a through-bore 17.

In the case of the formwork system 18 according to the invention, however, it makes sense for all frame formwork elements 1 to be provided with at least one guide device 10 according to the invention.

As can be seen from FIGS. 8 and 9, anchor fixations 19 are installed on the respective ends of the anchor rods 9. The anchor fixations 19 are formed as nuts in the exemplary embodiment. The anchor rods 9 have in this case a thread at their respective ends, onto which thread the nuts 19 are screwed in order to brace the frame formwork elements 1. This principle is basically already known from the prior art.

Within the scope of the formwork system 18 according to the invention, anchoring technology that can be operated in a one-sided as well as in a two-sided manner can also be used. Furthermore, the use of spacer tubes or cladding tubes can be provided within the scope of the invention.

In FIG. 9, a configuration is shown in which the anchor rod 9 runs conically, i.e. the anchor rod 9 tapers starting from one end to the other end, so that the use of spacer tubes can be dispensed with in a known manner.

In order to facilitate the use of anchor fixations 19, it is provided in the exemplary embodiment that the guide device 10 has an anchor bore 20 which serves to insert a part of the anchor fixation 19, generally an eyebolt of the anchor fixation 19, said eyebolt not being shown in more detail.

A set of guide devices 10—not shown in the exemplary embodiment—can be provided in the formwork system shown in FIGS. 8 and 9, wherein the set has different guide devices 10 for different types of anchor rods 9.

The invention claimed is:

1. A frame formwork element, comprising:

a frame and a formwork shell which can be attached to the frame, wherein the frame has at least two frame longitudinal parts and at least two frame transverse parts, and wherein at least one transverse bracing is fixed between the frame longitudinal parts, said transverse bracing having two transverse braces which run parallel to each other in a mutually spaced manner and between which a through-gap is formed such that anchor rods can pass through the through-gap, at least one guide device for forming an anchor point can be inserted into the through-gap, wherein the guide device defines an anchor hole such that one of the anchor rods can pass through the anchor hole and a securing region for securing the guide device to the transverse bracing, wherein the guide device has a conical guide part for the anchor rod to pass through, the conical guide part being flush with the anchor hole, wherein the guide device has a seal receptacle into which a seal can be detachably inserted or on which a seal is captively fixed, wherein the seal receptacle is positioned in such a way that the seal seals the guide device relative to an anchor bore in the formwork shell, wherein the anchor hole, the conical guide part, the seal receptacle, and the securing region of the guide device are formed in one piece.

2. The frame formwork element according to claim 1, wherein the guide device forms exactly the one anchor point and the guide device has exactly the one anchor hole.

3. The frame formwork element according to claim 1, wherein the anchor hole, the conical guide part, the seal receptacle, and the securing region of the guide device are formed of plastics material.

4. The frame formwork element according to claim 1, wherein the frame longitudinal parts have a plurality of through-bores such that anchor rods can pass through the plurality of through-bores.

5. The frame formwork element according to claim 4, wherein the at least one through-gap is arranged flush between a pair of the plurality of through-bores which are positioned at a same height on different of the at least two frame longitudinal parts.

6. The frame formwork element according to claim 1, wherein the at least one transverse bracing comprises at least two transverse bracings and the through-gap comprises at least two through-gaps such that each of the at least two transverse bracings defines one of the at least two through-gaps, wherein at least one guide device is inserted into each of the at least two through-gaps.

7. The frame formwork element according to claim 1, wherein the at least one guide device comprises a plurality of guide devices, the plurality of guide devices being inserted into the through-gap of the at least one transverse bracing.

8. The frame formwork element according to claim 1, wherein the guide device can be replaced at any position along the through-gap and can be secured to the transverse bracing.

9. A formwork system having at least two frame formwork elements according to claim 1 and a plurality of anchor rods in order to brace the frame formwork elements in a mutually spaced manner.

10. The frame formwork element according to claim 1, wherein the seal receptacle is located within the anchor bore or is positioned in such a way that the seal closes a gap between a front end of the conical guide part penetrating the anchor bore and an inner wall of the anchor bore of the formwork shell.

11. The frame formwork element according to claim 1, wherein the seal is located within the anchor bore or is positioned in such a way that the seal closes a gap between a front end of the conical guide part penetrating the anchor bore and an inner wall of the anchor bore of the formwork shell.

* * * * *